United States Patent [19]

Moore et al.

[11] Patent Number: 4,593,901

[45] Date of Patent: Jun. 10, 1986

[54] DUAL-SUSPENSION STRIKING BALLS

[76] Inventors: Ryan C. Moore, Rte. 49, Box 157, Bernhards Bay, N.Y. 13028; Daniel P. Smith, 217-C Kibbie Lake Rd., Constantia, N.Y. 13044

[21] Appl. No.: 761,555

[22] Filed: Aug. 1, 1985

[51] Int. Cl.[4] ..... A63B 69/22

[52] U.S. Cl. ..... 272/78; 273/58 C; 273/413

[58] Field of Search ..... 273/413, 58 C; 272/76, 272/77, 78

[56] References Cited

U.S. PATENT DOCUMENTS

| | | | |
|---|---|---|---|
| 445,747 | 2/1891 | Cook | 272/77 |
| 612,173 | 10/1898 | Newton | 273/58 C |
| 672,099 | 4/1901 | Jackson | 273/58 C |
| 1,628,973 | 5/1927 | Harley | 272/78 |
| 2,548,089 | 4/1951 | Wycosky | 272/78 |
| 4,330,131 | 5/1982 | Warehime | 273/413 |
| 4,346,902 | 8/1982 | Warehime | 273/413 X |

*Primary Examiner*—William H. Grieb

*Attorney, Agent, or Firm*—Charles S. McGuire

[57] ABSTRACT

A pair of stuffed or, preferably, inflated bags or balls are suspended by respective elastic cords or strips from a support, such as a slotted buckle, permitting selective adjustment of the length of the strips. The buckles are attached by universal-type, swivel connectors to opposite ends of a U-shaped arm which is supported at its center from a fixed, overhead support by connecting means which also permit universal, swiveling motion of the arm, which may also be pivoted about a vertical axis with respect to the connecting means. The balls may be struck by the hands or feet, depending upon the height of adjustment, of one or more individuals utilizing the apparatus either solely for exercise or amusement, or as a game with specified rules or patterns.

10 Claims, 1 Drawing Figure

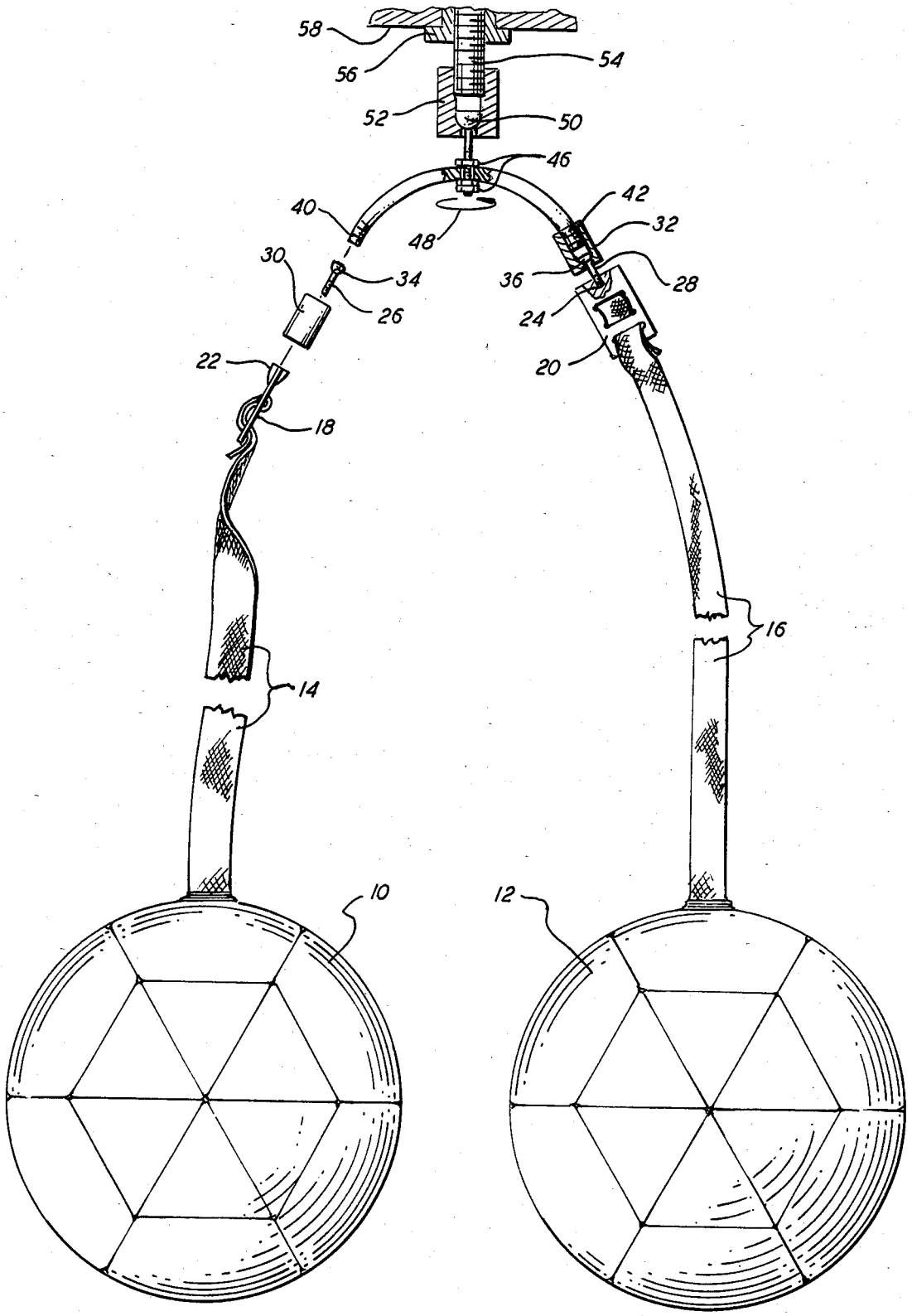
58
56
54
52
50
46
40
42
48
32
30
34
36
28
26
24
22
20
18
16
14
10
12

DUAL-SUSPENSION STRIKING BALLS

BACKGROUND OF THE INVENTION

The present invention relates to sports training, exercising or game apparatus of the type wherein a suspended bag or ball is struck and, more specifically, to such apparatus wherein a pair of striking members are individually suspended from an overhead support.

An early example of the familiar, inflated punching bag is shown in U.S. Pat. No. 445,747. U.S. Pat. Nos. 1,628,973 and 2,548,089 disclose improved forms of swivel hangers for punching bags. An arrangement of tethered balls is described in U.S. Pat. No. 4,330,131 wherein a plurality of balls are each connected by a tether line to a freely positioned central ring or hub.

The principal object of the present invention is to provide apparatus including suspended punching or striking members which may be used for exercise and/or entertainment by one or more individuals.

Another object is to provide exercise or game apparatus having a plurality of balls or bags suspended from a single overhead support for striking by the hands or feet by one or more individuals.

A further object is to provide apparatus for exercise, skill training or recreation including a plurality of balls suspended from unitary support means and freely movable in all directions about said support means.

Other objects may in part be obvious and may in part appear hereinafter.

SUMMARY OF THE INVENTION

In accordance with the foregoing objects, the invention contemplates a pair of inflated balls or bags, preferably spherical in shape, each suspended by an elastic cord or strip secured thereto at one end and extending to a connection with support means preferably of a type permitting adjustment of the length of the strip between the bag and support. In the disclosed embodiment, the supports are in the form of slotted members through which the elastic strips are passed. The slotted members are connected to opposite ends of a U-shaped arm by means permitting universal pivotal movement of the slotted members and thus of the elastic strips and balls.

The arm is suspended upon a post passing loosely through an opening in the post and thus rotatable about the axis thereof. The post in turn is suspended from a fixed, overhead support by means, such as a ball and socket connection, permitting universal pivotal movement of the post with respect to the overhead support.

The balls are thus freely suspended at a desired height and may be set in motion by striking and/or kicking to swing about their pivotal and rotational mountings. Various forms of free exercise or games may be performed with the plurality of balls separately suspended from a common overhead support.

BRIEF DESCRIPTION OF THE DRAWING

The single FIGURE is a front elevations view, with portions in section and other portions exploded, showing a preferred form of the invention.

DETAILED DESCRIPTION

Referring now to the drawing, a pair of resilient striking members in the form of bags or balls 10 and 12 are freely suspended upon strips 14 and 16, respectively, which are fixedly connected by stiching or other convenient means to the balls. The term "resilient" is used herein to indicate that balls 10 and 12 may be struck with relatively high force with bare hand or feet without significant possibility of injury or discomfort, although they may be inflated to a relatively high degree of rigidity. Balls 10 and 12 are preferably essentially spherical in shape, comprising a flexible outer covering stuffed with a resilient material or inflated with air.

Strips 14 and 16 extend from their connections with balls 10 and 12 to pass through open, transverse slots in support members 18 and 20, respectively, one of which is seen from the front and the other from the side. In this manner, the length of strips 14 and 16 between balls 10 and 12, and support members 18 and 20 may be selectively adjusted, while still providing a firm connection to the supports.

An internally threaded opening is provided in enlarged upper portions 22 and 24 of support members 18 and 20, respectively, wherein the lower ends of posts 26 and 28 are threadedly secured. Posts 26 and 28 pass loosely through openings in the lower ends of socket members 30 and 32, respectively, being suspended therefrom for freely pivoting, universal motion by upper end portions 34 and 36, having partially spherical surfaces, on posts 26 and 28, respectively, engaging similarly shaped internal sockets communicating with the openings in members 30 and 32.

Arm 38 is substantially U-shaped in the illustrated embodiment, extending between opposite, threaded end portions 40 and 42 which are secured in internally threaded openings in the upper ends of members 30 and 32. Post 44 passes loosely through an opening at the center of arm 38 which is secured by nuts 46 upon post 44 for rotational movement about the axis thereof, as indicated by arrow 48. Upper end portion 50 of post 44 has a partially spherical outer surface which engages a similarly shaped socket in socket member 52, post 44 passing loosely through an opening in the lower end of member 52 communicating with the socket. Threaded stud 54 is engaged at its lower end in an internally threaded opening in the upper end of member 52, and at its upper end in internally threaded collar 56 which is permanently secured in ceiling 58 or other overhead support.

Thus, balls 10 and 12 are separately suspended from a unitary support and may be set in motion separately or at the same time, in any desired direction. Elasticity of strips 14 and 16 permits movement of balls 10 and 12 a greater distance from their respective support members than in the initial, unflexed condition of the strips, e.g., by applying a greater striking force. Each of balls 10 and 12 has a respective, universal-type mounting means, and the single universal-type mounting means is shared by each ball, as is the rotational movement of arm 38 on post 44. This provides a great deal of freedom of individual movement of the balls, although movement of each ball also affects the other through the single arm 48 and its unitary mounting means.

What is claimed is:

1. Game or exercise apparatus of the type having freely suspended portions for striking by the hands or feet, said apparatus comprising, in combination:

(a) a pair of striking members for forcible contact by hands or feet;

(b) a pair of elongated, elastic strips fixedly connected at one end of each to respective ones of said striking members;

(c) a pair of support members to which the other ends of said strips are respectively connected for selective adjustment of the length of said strip between said support and striking members;

(d) an arm having opposite, spaced ends;

(e) a pair of first members connecting said support members respectively to said opposite ends of said arm for universal, pivotal movement with respect thereto, (f) a fixed, overhead support; and (g) a second member connecting said arm, at a position intermediate of said opposite ends, to said overhead support for universal, pivotal movement with respect thereto.

2. The invention according to claim 1 wherein said striking members are of the same size.

3. The invention according to claim 2 wherein said striking members are substantially spherical.

4. The invention according to claim 3 wherein said striking members comprise inflated, resilient members.

5. The invention according to claim 1 wherein said support members are in the form of slotted buckles with said strips passing through the slots thereof for selective length adjustment.

6. The invention according to claim 1 wherein said arm is substantially U-shaped.

7. The invention according to claim 1 wherein said first connecting members each comprise a post attached at one end to a respective one of said support members and having an at least partially spherical portion at the opposite end engaged in socket means on said opposite ends of said arm.

8. The invention according to claim 7 wherein said socket means are formed in a pair of separate members attached to said opposite ends of said arms.

9. The invention according to claim 1 wherein said second connecting member comprises a post attached at one end to said arm at a position substantially mid-way between said opposite ends thereof, and having an at least partially spherical portion at the opposite end engaged in socket means on said fixed, overhead support.

10. The invention according to claim 9 wherein said arm is rotatable upon said post about the axis thereof.

* * * * *